US007511627B2

(12) United States Patent
Holoyda

(10) Patent No.: US 7,511,627 B2
(45) Date of Patent: Mar. 31, 2009

(54) CHILD LOCATOR

(76) Inventor: Hang N. Holoyda, 1220 North Rd., Belmont, CA (US) 94002

( * ) Notice: Subject to any disclaimer, the term of this patent is extended or adjusted under 35 U.S.C. 154(b) by 278 days.

(21) Appl. No.: 11/467,328

(22) Filed: Aug. 25, 2006

(65) Prior Publication Data

US 2008/0055072 A1 Mar. 6, 2008

(51) Int. Cl.
*G08B 23/00* (2006.01)

(52) U.S. Cl. ..... 340/573.4

(58) Field of Classification Search ..... 340/573.4, 340/539.15, 573.1, 539.21, 572.1; 455/73
See application file for complete search history.

(56) References Cited

U.S. PATENT DOCUMENTS 5,119,072 A 6/1992 Hemingway
5,289,163 A * 2/1994 Perez et al. ..... 340/539.32
5,307,763 A * 5/1994 Arthur et al. ..... 119/718
5,617,074 A 4/1997 White
6,396,403 B1 5/2002 Haner
6,529,131 B2 * 3/2003 Wentworth ..... 340/573.1
6,593,851 B1 7/2003 Bornstein
6,826,120 B1 11/2004 Decker et al.
7,042,361 B2 * 5/2006 Kazdin et al. ..... 340/573.4
7,098,785 B2 * 8/2006 Wong et al. ..... 340/539.15
7,259,671 B2 * 8/2007 Ganley et al. ..... 340/539.23
7,385,513 B2 * 6/2008 Everest et al. ..... 340/573.1

* cited by examiner

*Primary Examiner*—Phung Nguyen
(74) *Attorney, Agent, or Firm*—Dale J. Ream

(57) ABSTRACT

A child locator that enables a parent to locate a child includes a master unit for wear by a parent and a monitored unit for wear by a child. The master unit may actuate an on-board alarm when its processor determines that the monitored unit is beyond a first predetermined distance and may actuate an alarm on the monitored unit when the separation distance is beyond another distance. The first and second predetermined distances may be the same of different. The child locator may also actuate the monitored unit manually and the alarms may be audible or visual. Once an alarm on the monitored unit is activated, a signal from the master unit is required to deactivate it. The master unit may include a directional antenna for determining a position on the monitored unit. The monitored unit may deliver voice data to a speaker at the monitored unit.

17 Claims, 6 Drawing Sheets

CHILD LOCATOR

BACKGROUND OF THE INVENTION

This invention relates generally to child tracking or locating devices and, more particularly, to a child locator that enables an adult to locate a monitored device, to actuate an alarm at the monitored device automatically if a predetermined separation distance is reached or manually as desired, or to communicate with the monitored device.

Parents and children are frequently in environments or situations where they may become separated. This separation may be inadvertent, such as straying away at a shopping mall, or voluntary, such as playing at a park or beach. In either case, a parent or guardian often desires to locate the child very quickly to verify the child's safety. Depending on the situation, an audible alarm worn by the child may be desired while other time, say at the beach at night, a bright visual alarm might be more desirable. Of course, it would be desirable to just be able to hear the child playing without activating an audible or visual alarm. Or, in the case of a child merely playing at a friend's house down the street, a walkie-talkie type feature may be sufficient to locate and communicate instructions to the child.

Various devices have been proposed in the art for locating and/or tracking a child. For example, devices utilizing global position satellite technology are useful for locating an exact geographical position but are somewhat expansive and unnecessary when a child may be only a short distance away from the parent. Other systems merely propose two-way pagers worn by parent and child. Although assumably effective for their intended purposes, the existing devices do not provide both locating and alert means suitable for many different types of circumstances.

Therefore, it would be desirable to have a child locator for providing a visual direction indication of where a monitored unit (with a child) is located in relation to a master unit (with the parent). Further, it would be desirable to have a child locator that provides an audible or visual alarm either when a separation distance exceeds a predetermined distance or manually. In addition, it would be desirable if the child locator also includes both a one-way communication and a two-way walkie-talkie feature.

SUMMARY OF THE INVENTION

A child locator according to the present invention includes a master unit, which may be worn by a parent/guardian, and a monitored unit, which may be worn by a child. Both units, for example, may be strapped about the person's wrist. The master unit includes components that will enable it to determine a directional location of the monitored unit, to determine a distance between the units, to actuate an alarm on the monitored unit, and even to communicate audio signals to the monitored unit. The monitored unit includes components that enable it to provide an alert when actuated and to receive audible signals from the master unit.

The master and monitored units may set the same or different predetermined distances at which alarms are actuated. There are two desirable aspects to this feature. In one case, the parent may want the master unit to alert when the child is, say, 50 yards away but not to actuate the monitored unit's alarm until it is, say, 75 yards away. In this case, the parent may be able to visually check the child's location or call him back before the child's alarm sounds. This would help minimize false alarms. Another desirable aspect to this feature is that the monitored unit may have a predetermined distance at which it will remind the child that he is getting too far away. However, the master unit (with the parent) is not actuated until a larger predetermined separation sequence is reached. It is also a key feature that once the monitored unit's alarm has been actuated as being too far from the master unit, it can only be deactivated by a signal sent from the master unit.

Therefore, a general object of this invention is to provide a child locator that enables a parent or guardian to monitor the location of a child and to be alerted if the child moves beyond a predetermined distance from the parent.

Another object of this invention is to provide a child locator, as aforesaid, that can determine a relative distance and direction of a monitored device and can visually display such information.

Still another object of this invention is to provide a child locator, as aforesaid, in which alarms at a master unit and monitored unit may be actuated according to the same or different predetermined separation distances.

Yet another object of this invention is to provide a child locator, as aforesaid, in which the master unit may be utilized to manually actuate the monitored unit alarm.

A further object of this invention is to provide a child locator, as aforesaid, which includes a mode in which the monitored unit alarm can only be deactivated by a signal from the master unit.

A still further object of this invention is to provide a child locator, as aforesaid, in which the master unit may send voice data to the monitored unit in a walkie-talkie type feature.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
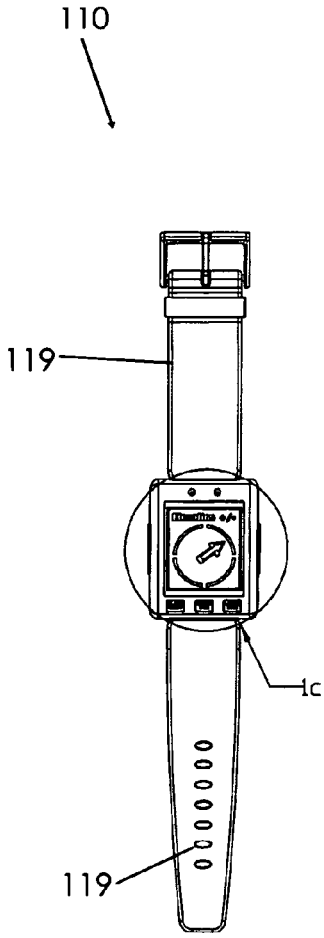
FIG. 1*a* is a top view of a master unit of the child locator apparatus according to the embodiment of the present invention.
Figure 1B:
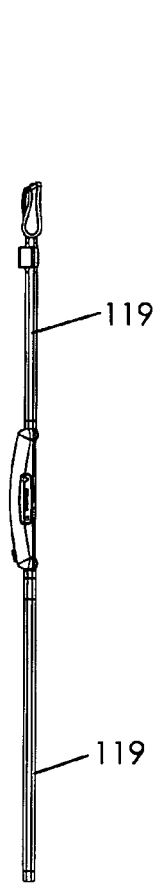
FIG. 1*b* is a side view of the master unit as in FIG. 1*a;*

A child locator apparatus 100 according to the present invention will now be described in detail with reference to FIGS. 1*a* through 6 of the accompanying drawings. More particularly, a child locator apparatus 100 according to the current invention includes a master unit 110 and a monitored unit 120.

The master unit 110 (shown in FIGS. 1*a* through 2*b* and FIG. 5) may have a processor 112 (also referred to as a master processor) in electrical communication with a transmitter 113 (also referred to as a master transmitter), a receiver 114 (also referred to as a master receiver), an alarm 115 (also referred to as a master alarm), an input device 116 (also referred to as a master input device), a microphone 117 (also referred to as a master microphone), and/or a power source 118 (also referred to as a master power source). The master alarm 115 may include, for example, a speaker 115*a* (also referred to as a master speaker), a display 115*b* (also referred to as a master display), and/or a visual alarm 115*c* (also referred to as a master visual alarm). This display 115*b* may be, for example, a liquid crystal display (LCD), and the visual alarm 115*c* may be, for example, one or more LED. The power source 118 may be, for example, a battery. Means for selectively attaching the master unit 110 to a wearer may be included, such as straps 119.

Figure 1C:
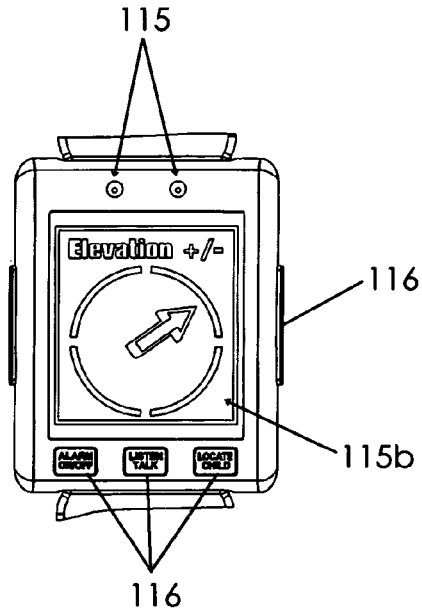
FIG. 1*c* is an isolated view on an enlarged scale taken from FIG. 1*a;*
Figure 2A:
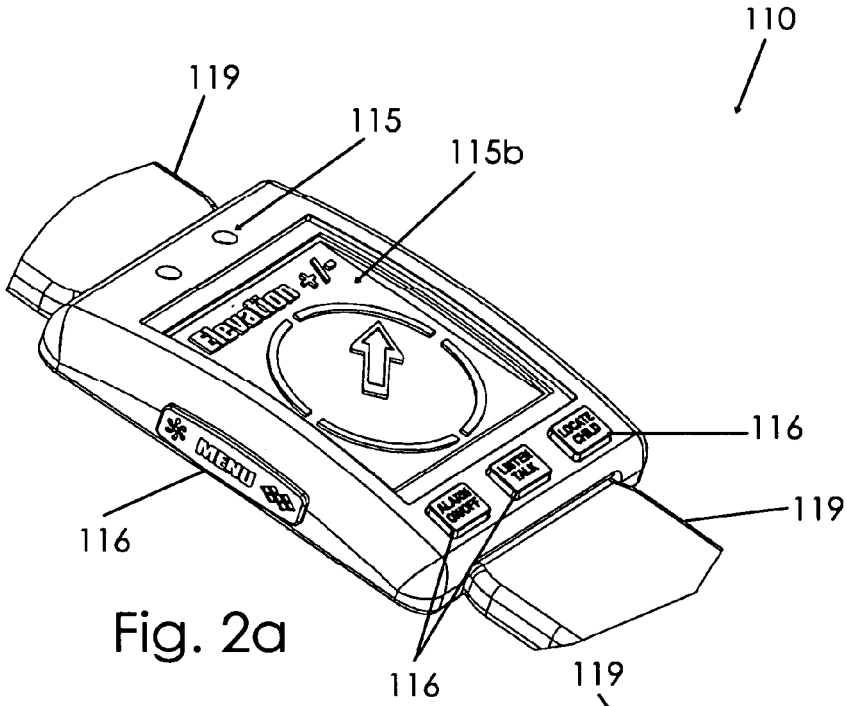
FIG. 2*a* is a perspective view on an enlarged scale of the master unit as in FIG. 1*c;*
Figure 2B:
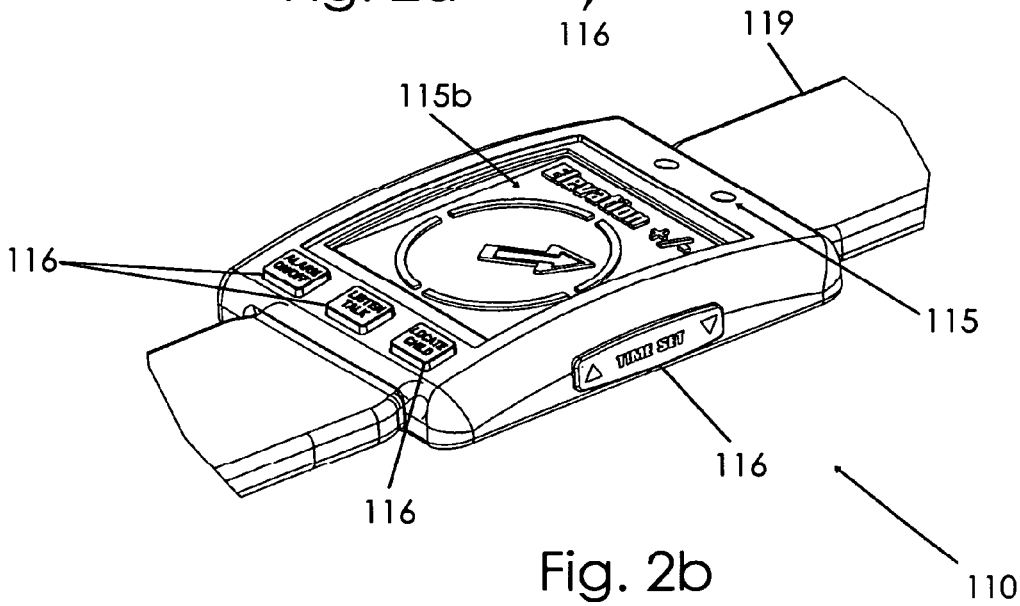
FIG. 2*b* is another perspective view of the master unit as in FIG. 2*a;*
Figure 3A:
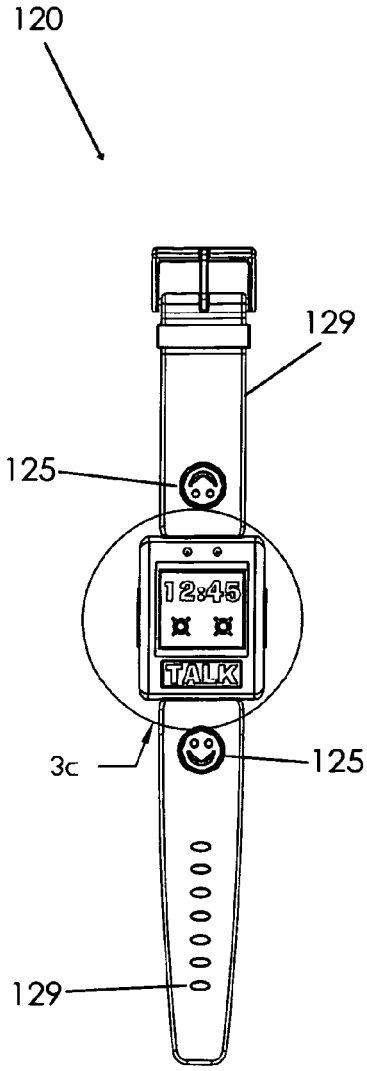
FIG. 3*a* is a top view of a monitored unit of the child locator according to the preferred embodiment of the present invention.
Figure 3B:
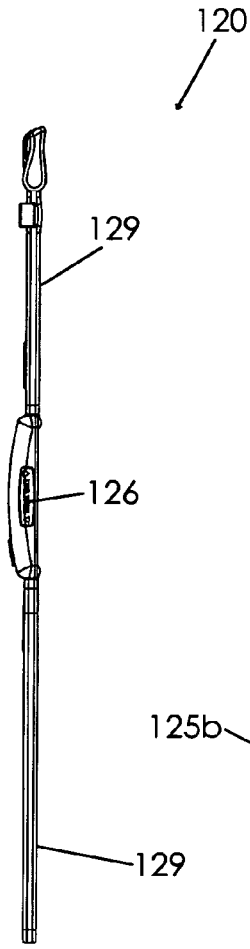
FIG. 3*b* is a side view of the monitored unit as in FIG. 3*a;*
Figure 3C:
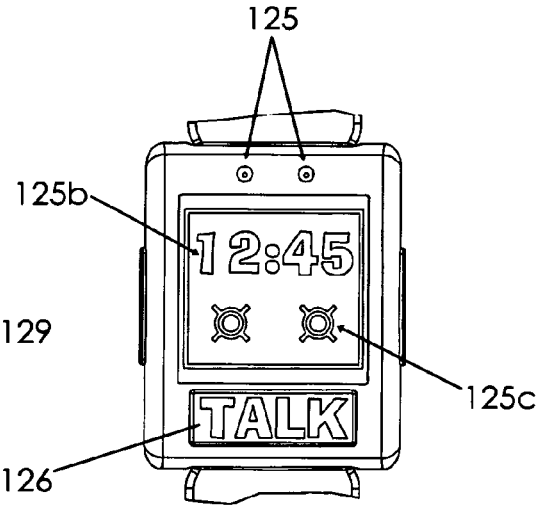
FIG. 3*c* is an isolated view on an enlarged scale of the monitored unit as in FIG. 3*a;*

While all of the input buttons associated with the master unit 110 are labeled with reference numeral 116, it is understood that each one is electrically coupled to the master processor 112 and trigger different functions and programming. More particularly, the master input devices may include an on/off button, a button to activate the Talk feature, a button to activate the Locate Child feature, a button activate an on-screen Menu, and one to initiate a Time Set routine (FIGS. 1*c*, 2*a*, 2*b*).

The monitored unit 120 (shown in FIGS. 3*a* through 5) may have a processor 122 (also referred to as a monitored processor) in electrical communication with a transmitter 123 (also referred to as a monitored transmitter), a receiver 124 (also referred to as a monitored receiver, an alarm 125 (also referred to as a monitored alarm), an input device 126 (also referred to as a monitored input device), a microphone 127 (also referred to as a monitored microphone), and/or a power source 128 (also referred to as a monitored power source). The monitored alarm 125 may include, for example, a speaker 125*a* (also referred to as a monitored speaker), a display 125*b* (also referred to as a monitored display), and/or a visual alarm 125*c* (also referred to as a monitored visual alarm). This display 125*b* may be, for example, a liquid crystal display (LCD), and the visual alarm 125*c* may be, for example, one or more LED. The power source 128 may be, for example, a battery. Means for selectively attaching the monitored unit 120 to a wearer may be included, such as straps 129.

Figure 4A:
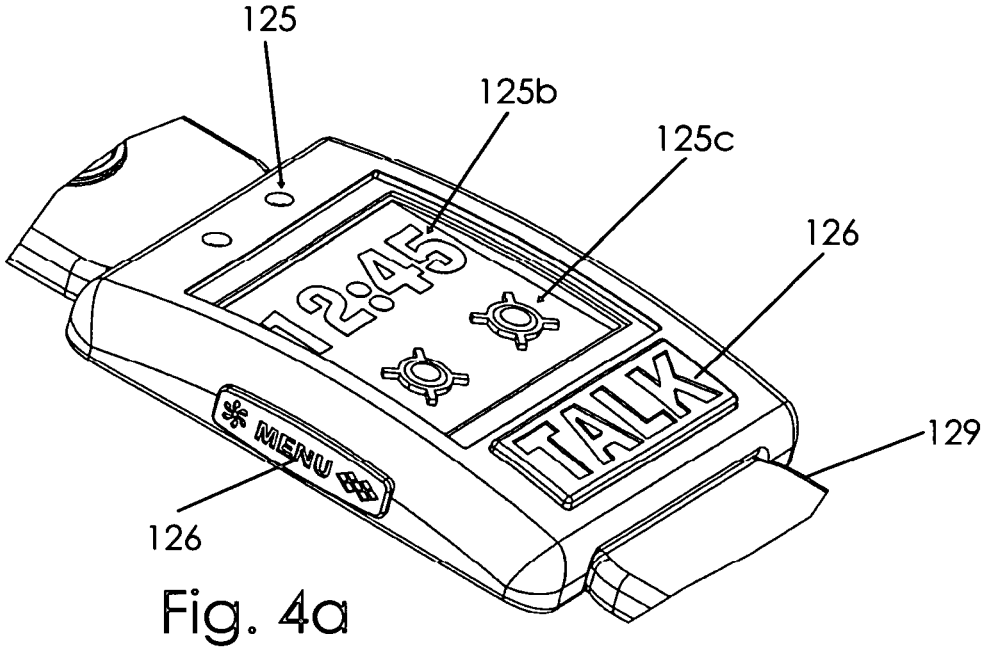
FIG. 4*a* is a perspective view on an enlarged scale of the monitored unit as in FIG. 3*c;*
Figure 4B:
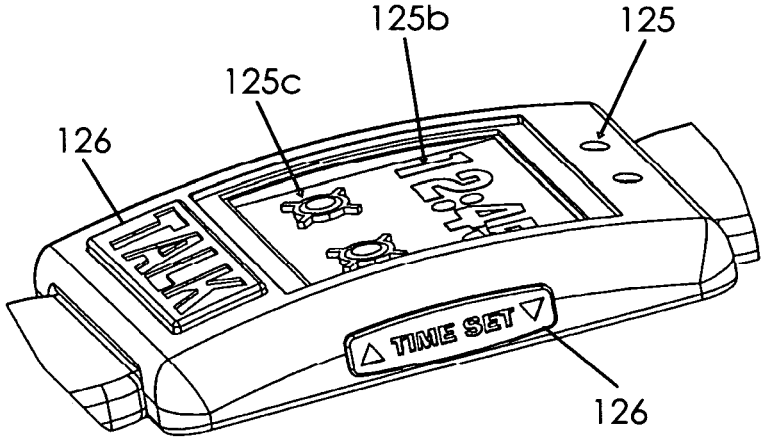
FIG. 4*b* is another perspective view of the monitored device as in FIG. 4*a;*
Figure 5:
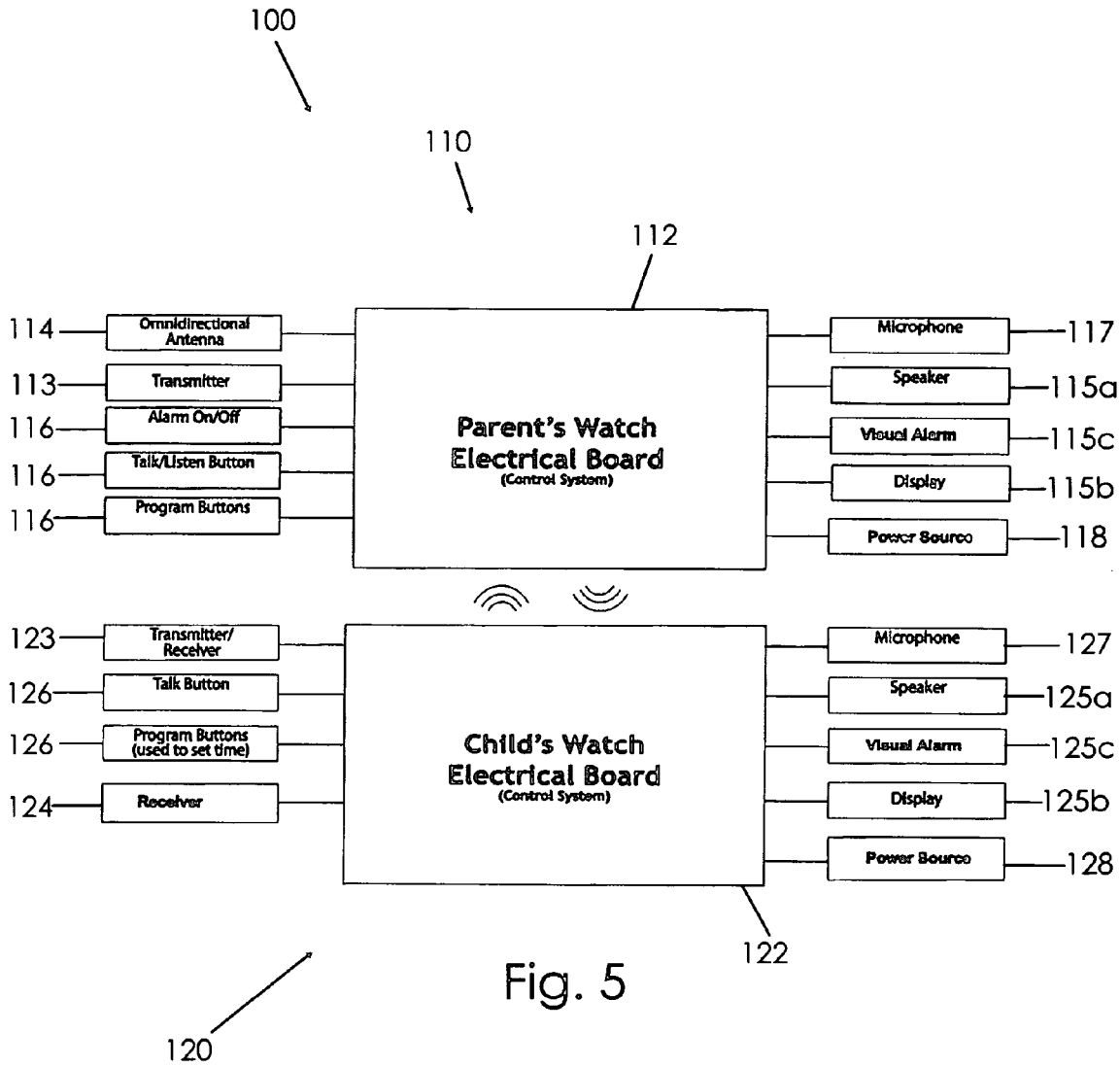
FIG. 5 is a block diagram of the electronic components of the child locator apparatus according to the preferred embodiment of the present invention.

While all of the input buttons associated with the monitored unit 120 are labeled with reference numeral 126, it is understood that each one is electrically coupled to the monitored processor 122 and trigger different functions and programming. More particularly, the monitored input device 126 may refer to a button to activate the Talk feature (FIG. 3*c*), a button to initiate an on-screen Menu (FIG. 4*a*), and a button to initiate a Time Set routine (FIG. 4*b*).

Means may be included for actuating the master alarm 115 (e.g., the master speaker 115*a*) when the monitored unit 120 is not within a first predetermined distance from the master unit 110. More particularly, the master processor 112 may include programming to determine whether the monitored unit 120 is within the first predetermined distance from the master unit 110 and programming to actuate the master alarm 115 (e.g., the master speaker 115*a*) when the monitored unit is not within the first predetermined distance from the master unit 110. This may be accomplished in various ways, including by monitoring whether the master receiver 114 receives a reply from the monitored transmitter 123 after the master transmitter 113 sends a signal, by determining the strength of a signal received by the master receiver 114 from the monitored transmitter 123, etc.

Means may be included for actuating the monitored alarm 125 (e.g., the monitored speaker 125*a*) when the monitored unit 120 is not within a second predetermined distance from the master unit 110. More particularly, the monitored processor 122 may include programming to determine whether the monitored unit 120 is within the second predetermined distance from the master unit 110 and programming to actuate the monitored alarm 125 (e.g., the monitored speaker 125*a*) when the monitored unit 120 is not within the second predetermined distance from the master unit 110. This may be accomplished in various ways, including by monitoring whether the monitored receiver 124 receives a signal from the master transmitter 113, by determining the strength of a signal received by the monitored receiver 124 from the master transmitter 113, etc.

The first predetermined distance may be substantially equal to the second predetermined distance (e.g., both may be seventy-five feet), or the first predetermined distance may be different from the second predetermined distance (e.g., the first predetermined distance may be fifty feet and the second predetermined distance may be seventy-five feet). In exemplary embodiments, the first and second predetermined distances may be operatively selected using the master input device 116 and/or the monitored input device 126. More particularly, the master processor 112 may have programming for allowing a user to select the first and/or second predetermined distances using the master input device 116, and/or the monitored processor 122 may have programming for allowing a user to select the first and/or second predetermined distances using the monitored input device 126.

The master processor 112 may have programming for actuating the master transmitter 113 to transmit an alarm signal to the monitored transmitter 123 upon receiving an alarm signal from the master input device 116 and/or programming for actuating the master transmitter 113 to transmit a deactivation signal to the monitored transmitter 123 upon receiving a deactivation signal from the master input device 116. The monitored processor 122 may have programming for actuating the monitored alarm 125 (e.g., the monitored speaker 125*a*, the monitored display 125*b*, and/or the monitored visual alarm 125*c*) upon receiving an alarm signal from the monitored input device 126 and/or the master transmitter 113. The monitored processor 122 may additionally or alternately include programming for deactivating the monitored alarm 125 upon receipt of a deactivation signal by the monitored receiver 124 sent from the master transmitter 113. In a currently preferred embodiment, the monitored alarm 125 may only be deactivated after receipt of a deactivation signal sent by the master transmitter 113.

The master receiver 114 may be a directional antenna, and the master processor 112 may have programming for determining a direction to the monitored unit 120 using data from the directional antenna 114 and programming for actuating the master display 115*b* to present the determined direction to the monitored unit 120.

The master processor 112 may include programming for actuating the master transmitter 113 to transmit a microphone activation signal to the monitored receiver 124 and programming for actuating the master speaker 115*a* to audibly present data collected by the monitored microphone 127, transmitted by the monitored transmitter 123, and received by the master received 114. It is understood that this feature enables the parent at the master unit to merely listen in to sounds occurring at the monitored unit. The master processor 112 may additionally or alternately include programming for actuating the master transmitter 113 to transmit data collected by the master microphone 117 to the monitored receiver 124 upon receipt of a master microphone activation signal from the respective master input device 116 associated with the listen/talk feature (FIG. 1*c*).

The monitored processor 122 may include programming for actuating the monitored microphone 127 upon receipt of the microphone activation signal by the monitored receiver 124 and actuating the monitored transmitter 123 to transmit data collected by the monitored microphone 127 to the master receiver 114. The monitored processor 122 may additionally or alternately include programming for actuating the monitored microphone 127 upon receipt of a microphone activation signal from the monitored input device 126 associated with the TALK feature (FIG. 3*c*) and actuating the monitored transmitter 123 to transmit data collected by the monitored microphone 127 to the master receiver 114. The monitored processor 122 may additionally or alternately include programming for actuating the monitored speaker 125*a* to audibly present data collected by the master microphone 117, transmitted by a the master transmitter 113, and received by the monitored receiver 124.

The master processor 112 may have programming for actuating the master display 115*b* to present time data (e.g., the time of day), and the monitored processor may have programming for actuating the monitored display 125*b* to present data(e.g., the time of day). Respective input device 116, 126 buttons may be pressed to initiate respective processor programming routines.

Figure 6:
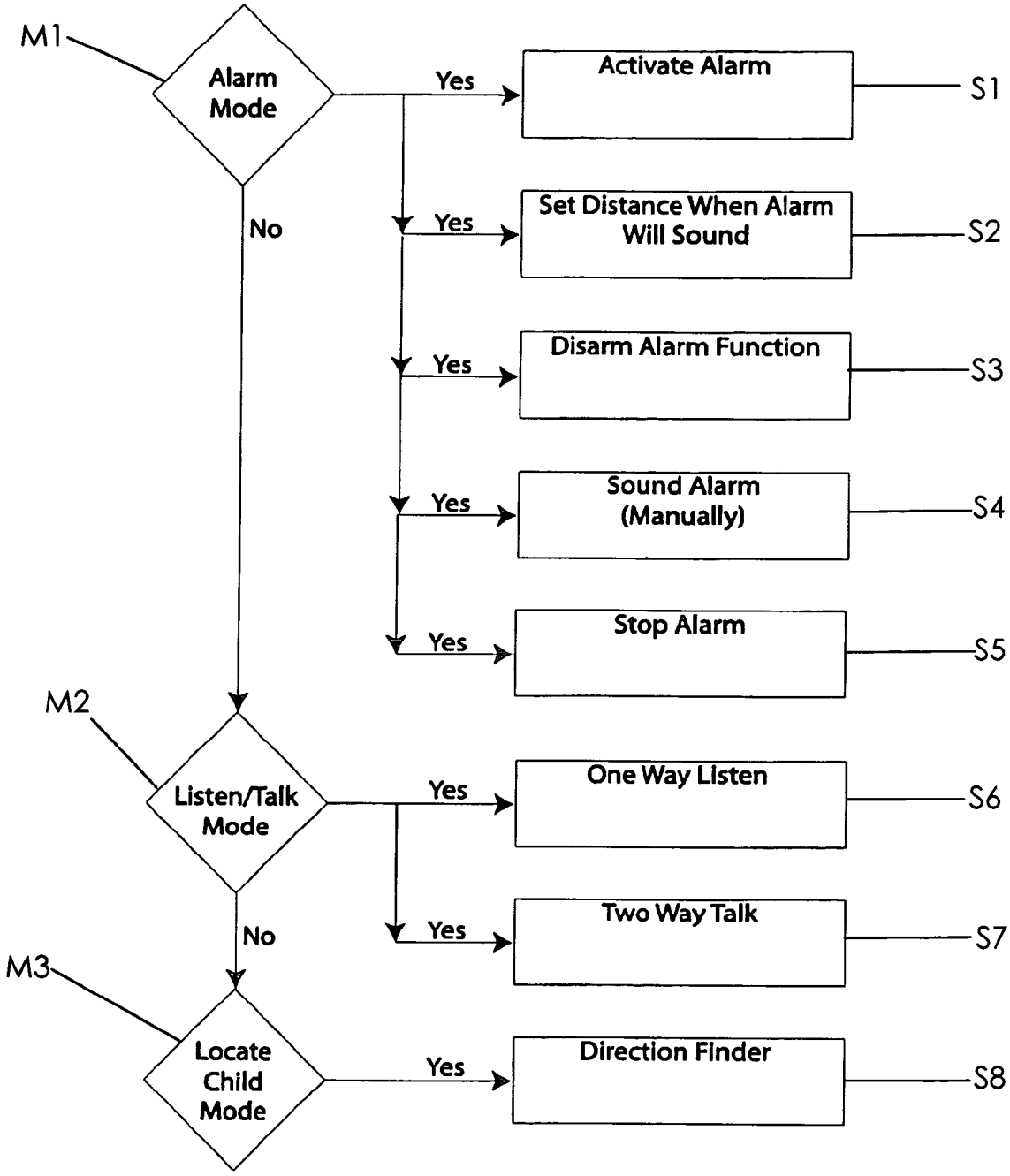
FIG. 6 is a flowchart illustrating an exemplary method of using the child locator apparatus according to the present invention.

FIG. 6 shows exemplary methods of using the child locator apparatus 100. While at the alarm mode M1, a user may activate the means for actuating the monitored alarm 125 when the monitored unit 120 is not within a second predetermined distance from the master unit 110 as discussed above and shown at S1. Also as discussed above, the master processor 112 may determine that the monitored 120 is greater than a first predetermined distance and activate the master alarm 115 only, assuming that the second predetermined distance has been set greater than the first predetermined distance.

As seen at S2, a user may operatively select the first and/or second predetermined distances using the respective master input device 116 and/or the respective monitored input device 126 as discussed above. As shown at S3 and S5, the master processor 112 may actuate the master transmitter 113 to transmit a deactivation signal to the monitored transmitter 123 to deactivate the monitored alarm 125 after the monitored alarm 125 is actuated as discussed above. The advantage of this feature is that it precludes the child from deactivating the alarm, or, more importantly, prevents an abductor from doing so. As shown at S4, the master and monitored alarms 115, 125 may be actuated manually using the master input 116 and the monitored input 126 buttons as discussed above.

While at the listen/talk mode M2, the master processor 112 may actuate the master transmitter 113 to transmit a microphone activation signal to the monitored receiver 124, the monitored transmitter 123 may transmit data collected by the monitored microphone 127, and the master speaker may audibly present the data collected by the monitored microphone, as discussed above. This is, essentially, one way sound transmission as shown at S6. As shown at S7, there may be two way sound transmission similar to that created by walkie talkies. More particularly, the master transmitter 113 may transmit data collected by the master microphone 117 to the monitored receiver 124 to be audibly displayed by the monitored speaker 125*a* and the monitored transmitter 123 may transmit data collected by the monitored microphone 127 to the master receiver 114 to be audibly displayed by the master speaker 115*a*, as discussed above.

While at the locate child mode M3, the master processor 112 may determine a direction to the monitored unit 120 and actuate the master display 115*b* to present the determined direction, as shown at S8 and discussed above.

It is understood that while certain forms of this invention have been illustrated and described, it is not limited thereto except insofar as such limitations are included in the following claims and allowable functional equivalents thereof.

What is claimed is as follows:

1. A child locator apparatus, comprising:

a master unit having a master processor in electrical communication with a master transmitter, a master receiver, a master display, a master speaker, a master input device, and a master power source;

a monitored unit having a monitored processor in electrical communication with a monitored transmitter, a monitored receiver, a monitored speaker, and a monitored power source;

means for actuating said master speaker when said monitored unit is not within a first predetermined distance from said master unit;

means for actuating said monitored speaker when said monitored unit is not within a second predetermined distance from said master unit;

wherein:

said monitored unit includes a monitored microphone in electrical communication with said monitored processor;

said master processor includes programming for actuating said master transmitter to transmit a microphone activation signal to said monitored receiver;

said monitored processor includes programming for actuating said monitored microphone upon receipt of said microphone activation signal by said monitored receiver and actuating said monitored transmitter to transmit data collected by said monitored microphone to said master receiver; and said master processor includes programming for actuating said master speaker to audibly present said data collected by said monitored microphone upon receipt of said data by said master receiver.

2. The child locator apparatus as in claim 1, wherein:

said means for actuating said master speaker includes programming in said master processor to determine whether said monitored unit is within said first predetermined distance from said master unit and programming in said master processor to actuate said master speaker when said monitored unit is not within said first predetermined distance from said master unit; and said means for actuating said monitored speaker includes programming in said monitored processor to determine whether said monitored unit is within said second predetermined distance from said master unit and programming in said monitored processor to actuate said monitored speaker when said monitored unit is not within said second predetermined distance from said master unit.

3. The child locator apparatus as in claim 1, wherein said first predetermined distance is substantially equal to said second predetermined distance.

4. The child locator apparatus as in claim 1, wherein said first predetermined distance is different from said second predetermined distance.

5. The child locator apparatus as in claim 1, wherein said master processor has programming for allowing a user to select said first and second predetermined distances using said master input device.

6. The child locator apparatus as in claim 1, wherein:

said monitored unit includes a monitored input device in electrical communication with said monitored processor;

said first and second predetermined distances are operatively selected using at least one element selected from the group consisting of said master input device and said monitored input device.

7. The child locator apparatus as in claim 1, wherein:

said master receiver is a directional antenna;

said master processor includes programming for determining a direction to said monitored unit using data from said directional antenna; and said master processor includes programming for actuating said master display to present said determined direction to said monitored unit.

8. The child locator apparatus as in claim 1, wherein:

said master unit includes a master microphone in electrical communication with said master processor;

said monitored unit includes said monitored microphone in electrical communication with said monitored processor;

said master processor includes programming for actuating said master transmitter to transmit data collected by said master microphone to said monitored receiver;

said monitored processor includes programming for actuating said monitored speaker to audibly present said data collected by said master microphone and transmitted by said master transmitter;

said monitored processor includes programming for actuating said monitored transmitter to transmit data collected by said monitored microphone to said master receiver; and said master processor includes programming for actuating said master speaker to audibly present said data collected by said monitored microphone and transmitted by said monitored transmitter.

9. The child locator apparatus as in claim 1, wherein:

said monitored unit has a monitored input device in electrical communication with said monitored processor;

said monitored unit has a monitored visual alarm in electrical communication with said monitored processor;

said monitored processor has programming for actuating said monitored speaker and said monitored visual alarm upon receiving an alarm signal from said monitored input device;

said master processor has programming for actuating said master transmitter to transmit a deactivation signal to said monitored transmitter upon receiving a deactivation signal from said master input device;

said monitored processor has programming for deactivating said monitored visual alarm and said monitored speaker upon receipt of said deactivation signal by said monitored receiver.

10. The child locator apparatus as in claim 9, wherein said monitored visual alarm and said monitored speaker may be deactivated only after receipt of said deactivation signal sent by said master transmitter.

11. The child locator apparatus as in claim 1, wherein:

said monitored unit has a monitored visual alarm in electrical communication with said monitored processor;

said master processor has programming for actuating said master transmitter to transmit an alarm signal to said monitored transmitter upon receiving an alarm signal from said master input device;

said monitored processor has programming for actuating said monitored speaker and said monitored visual alarm upon receipt of said alarm signal by said monitored receiver;

said master processor has programming for actuating said master transmitter to transmit a deactivation signal to said monitored transmitter upon receiving a deactivation signal from said master input device; and said monitored processor has programming for deactivating said monitored visual alarm and said monitored speaker upon receipt of said deactivation signal by said monitored receiver.

12. The child locator apparatus as in claim 11, wherein said monitored visual alarm and said monitored speaker may be deactivated only after receipt of said deactivation signal sent by said master transmitter.

13. The child locator apparatus as in claim 1, further comprising:

means for selectively attaching said master unit to a wearer; and means for selectively attaching said monitored unit to a wearer.

14. The child locator apparatus as in claim 1, wherein:

said master processor has programming for actuating said master display to present time data;

said monitored unit has a monitored display in electrical communication with said monitored processor; and said monitored processor has programming for actuating said monitored display to present time data.

15. A child locator apparatus, comprising:

a master unit having a master processor in electrical communication with a master transmitter, a master receiver, a master alarm, a master input device, and a master power source;

a monitored unit having a monitored processor in electrical communication with a monitored transmitter, a monitored receiver, a monitored alarm, and a monitored power source;

programming in said master processor to determine whether said monitored unit is within a first predetermined distance from said master unit and programming in said master processor to actuate said master alarm when said monitored unit is not within said first predetermined distance from said master unit;

programming in said monitored processor to determine whether said monitored unit is within a second predetermined distance from said master unit and programming in said monitored processor to actuate said monitored alarm when said monitored unit is not within said second predetermined distance from said master unit;

wherein:

said monitored unit has a monitored input device in electrical communication with said monitored processor;

said monitored unit includes a monitored microphone in electrical communication with said monitored processor;

said monitored unit has a monitored speaker in electrical communication with said monitored processor;

said master unit includes a master microphone in electrical communication with said master processor;

said master unit has a master speaker in electrical communication with said master processor;

said master processor includes programming for actuating said master transmitter to transmit a microphone activation signal to said monitored receiver;

said monitored processor includes programming for actuating said monitored microphone upon receipt of said microphone activation signal by said monitored receiver and actuating said monitored transmitter to transmit data collected by said monitored microphone to said master receiver;

said monitored processor includes programming for actuating said monitored microphone upon receipt of said microphone activation signal from said monitored input device and actuating said monitored transmitter to transmit data collected by said monitored microphone to said master receiver;

said master processor includes programming for actuating said master speaker to audibly present said data collected by said monitored microphone upon receipt of said data by said master receiver;

said master processor includes programming for actuating said master transmitter to transmit data collected by said master microphone to said monitored receiver upon receipt of a master microphone activation signal from said master input device:

said monitored processor includes programming for actuating said monitored speaker to audibly present said data collected by said master microphone and transmitted by said master transmitter.

16. The child locator apparatus as in claim 15, wherein:

said monitored alarm is a monitored visual alarm;

said monitored processor has programming for actuating said monitored speaker and said monitored visual alarm upon receiving an alarm signal from said monitored input device;

said master processor has programming for actuating said master transmitter to transmit an alarm signal to said monitored transmitter upon receiving an alarm signal from said master input device;

said monitored processor has programming for actuating said monitored speaker and said monitored visual alarm upon receiving said alarm signal from said master transmitter;

said master processor has programming for actuating said master transmitter to transmit a deactivation signal to said monitored transmitter upon receiving a deactivation signal from said master input device;

said monitored processor has programming for deactivating said monitored visual alarm and said monitored speaker upon receipt of said deactivation signal by said monitored receiver;

said monitored visual alarm and said monitored speaker may be deactivated only after receipt of said deactivation signal sent by said master transmitter;

said first and second predetermined distances are operatively selected using at least one element selected from the group consisting of said master input device and said monitored input device;

said master processor has programming for determining a direction to said monitored unit using data from said master receiver;

said master unit has a master display in electrical communication with said master processor; and said master processor has programming for actuating said master display to present said determined direction to said monitored unit.

17. The child locator apparatus as in claim 15, wherein:

said monitored unit has a monitored input device in electrical communication with said monitored processor;

said monitored processor has programming for actuating said monitored alarm upon receiving an alarm signal from said monitored input device;

said master processor has programming for actuating said master transmitter to transmit an alarm signal to said monitored transmitter upon receiving an alarm signal from said master input device;

said monitored processor has programming for actuating said monitored alarm upon receiving said alarm signal from said master transmitter;

said master processor has programming for actuating said master transmitter to transmit a deactivation signal to said monitored transmitter upon receiving a deactivation signal from said master input device;

said monitored processor has programming for deactivating said monitored alarm upon receipt of said deactivation signal by said monitored receiver; and said monitored alarm may be deactivated only after receipt of said deactivation signal sent by said master transmitter.

* * * * *